United States Patent [19]

Ustin

[11] 4,198,109

[45] Apr. 15, 1980

[54] BI-PIN FLUORESCENT LAMPHOLDER AND CONTACT

[75] Inventor: George Ustin, Croton-on-Hudson, N.Y.

[73] Assignee: North American Philips Corp., New York, N.Y.

[21] Appl. No.: 6,042

[22] Filed: Jan. 24, 1979

Related U.S. Application Data

[63] Continuation-in-part of Ser. No. 814,404, Jul. 11, 1977, abandoned.

[51] Int. Cl.[2] ..... H01R 33/08

[52] U.S. Cl. ..... 339/50 R; 339/53

[58] Field of Search ..... 339/50 R, 51, 52 R, 339/53

[56] References Cited

U.S. PATENT DOCUMENTS

| | | | |
|---|---|---|---|
| 2,280,747 | 4/1942 | Burt | 339/53 |
| 3,052,864 | 9/1962 | Gaynor | 339/53 |
| 3,060,400 | 10/1962 | Pistey | 339/53 |
| 3,337,837 | 8/1967 | Pistey | 339/53 |

*Primary Examiner*—Roy Lake
*Assistant Examiner*—DeWalden W. Jones
*Attorney, Agent, or Firm*—Algy Tamoshunas

[57] ABSTRACT

A lampholder for a medium bi-pin fluorescent lamp has a combination slot permitting either "straight-in" or "turn-lock" insertion. The lampholder contacts have a pin-contacting section supported for reliable resilient gripping of the lamp pins so that the lamps will not drop out accidently, while a planar contact mounting section and use of only one major fold reduce contact cost.

19 Claims, 7 Drawing Figures

BI-PIN FLUORESCENT LAMPHOLDER AND CONTACT

This is a Continuation-in-Part of application Ser. No. 814,404, filed July 11, 1977, now abandoned.

BACKGROUND OF THE INVENTION

1. Field of the Invention

The invention relates to lampholders for lamps having two parallel pins extending from an end to establish electrical contact, and more particularly to "medium bi-pin" fluorescent lampholders. Such lampholders are typically used in pairs, one for each end of a tubular lamp, and have a rigid molded plastic housing adapted to a mounting for a flat fluorescent fixture pan, the housing extending perpendicular to the fixture pan and receiving lamp pins by moving the lamp transversely to its longitudinal axis toward the pan, and inserting the pins through one or two slots in the lampholder.

These lampholders are usually made in "turn-lock" style, in which both pins are aligned to pass through one slot opening and the lamp is then rotated about its longitudinal axis to lock in place; and "straight-in" style which have a separate slot opening for each pin, and contacts that mechanically lock the pins in place as well as make electrical contact. A variety of housing styles and contacts for use in these styles have been devised over the years, and offer many different advantages and features.

2. Description of the Prior Art

Millions of lampholders of the turn-lock style are sold in the United States each year for residential and commercial use. As a result, many efforts to reduce cost and improve life or reliability have been made. U.S. Pat. No. 3,060,400 teaches a relatively complex contact for a turn-lock type lampholder; however, this contact is simple to install in a lampholder housing, and offers good isolation between movement of a lamp pin-contacting section and a connection wire pressure locking section. More recently, U.S. Pat. No. 3,337,837 teaches a different contact style which offers good wiping action of the contact but again is limited to the turn-lock construction.

For some purposes U-shape fluorescent tubes are preferred; and for these the turn-lock style cannot be used. A "straight-in" construction has been known for over 35 years, for example as disclosed in the U.S. Pat. to Burt, No. 2,280,747. More recently, many straight-in lampholder styles have been developed by different companies, such as the model 1615 made by Kulka Electric Corp. With these lampholders, the pins of a bi-pin fluorescent tube are pushed through parallel slots in the socket housing, and simultaneously engage contacts which lock them mechanically and complete the electrical circuit. In order to provide straight-line pin travel, with positive locking to prevent a tube from accidently falling from the socket, the known contacts for these sockets have been designed solely for straight-in lampholders. It has therefore been necessary to manufacture and stock separate contacts and lampholder housings for each type.

SUMMARY OF THE INVENTION

An object of the invention is to provide a lampholder which can be used both for turn-lock and straight-in lamp applications.

A further object is to provide a lampholder contact which is simple to manufacture, has little waste of material, and aligns all critical stress areas with the grain pattern of greatest strength.

A further object of the invention is to enable use of one contact design with turn-lock, straight-in, and combination use lampholders.

According to the invention, a lampholder housing has intersecting slots such that a bi-pin lamp end can be pushed in ("straight-in" technique) or can be twisted in by inserting with the pins in line and then rotating to the electrical contacting, locked position. The contacts contained in the lampholder are so arranged that the pins will engage and be gripped lockingly by the contacts upon either mode of lamp insertion.

According to a preferred embodiment of the invention, a lampholder housing has a front wall having intersecting slots for insertion of lamp contact-pins in a direction transverse to the pin axes; the slots include a U-shaped slot having two parallel legs and a semi-circular bottom portion, the legs of the U-slot being separated by a distance equal to the distance between contact-pins of a lamp so as to permit "straight-in" insertion; and a center slot parallel to the legs of the U-slot, extending to the bottom portion, and two arcuate slot segments between the center slot and the respective U-legs arranged so as to form, in conjunction with the semi-circular bottom of the U, a circular slot. For use with this socket, the contact means includes two contact elements, one for each pin, each pin-contacting element having a pin-gripping portion disposed at a respective side of the circular slot, the portions disposed diametrically opposite each other. The pin-gripping portions of the contacts are biased toward each other so as to protrude into the circular slot in the absence of an inserted lamp pin, and the portions of each contact element adjacent to and on each side of the pin-gripping portion are so arranged as to be engageable by a lamp pin moving downward along the leg of the U-slot or circumferentially around the bottom of the circular slot so as to move the pin-contacting element resiliently outward until the pin-gripping portion engages the pin.

Still further, according to the preferred embodiment the contact elements each have a pin-contacting section arranged substantially perpendicular to a front wall of the housing, the pin-contacting section extending between a mounting section and a distal end. The pin-contacting section is supported against displacement of the pin-gripping portion away from the center of the lampholder toward the lampholder's side walls by a contact abutment surface perpendicular to the front wall, located between the circular slot and the entrance ends of the U-slot legs, and an internal boss between the pin-gripping portion and the mounting portion of the contact element, the boss arranged to be engaged by a bearing portion of th pin-contacting section also substantially perpendicular to the front wall, the boss advantageously having sufficient cross-section to function also for receiving a staple which holds the lampholder's rear cover in place.

A particular advantage of the disclosed combination style of lampholder is realized in lamp installations in cramped quarters, where it is very difficult for an installer to reach one end of the lamp. When identical lampholder sockets according to the invention are used at each end of a fixture, a lamp can be installed by inserting one end into the far socket with the pins aligned above each other, and then twisting the lamp so as to lock that end, in the meantime holding the other end close to but not inserted into its socket. After the one end has been put into place by a turn-lock motion, a straight-in pushing motion can be used to install the second end. Conversely, when removing a tube, a straight pulling motion can be used for the near end of the tube, followed by a twist unlocking motion for the far end of the tube. This avoids placing a high bending stress on the thin glass wall of the fluorescent tube, while at the same time the risk of premature disconnection of the far end of the tube, which may be followed by inadvertent banging of the tube into hard objects, is avoided.

Further, in accordance with the invention a contact element for the above-described lampholder, also useable with conventional straight-in or turn-lock lampholders, consists of a unitary metal element, having a planar mounting portion, an intermediate section extending in a longitudinal direction and substantially co-planar with the mounting portion toward the entrance ends of the lampholder housing, and a pin-contacting section extending from said intermediate section toward and past a pin-contacting region, the pin-contacting section being substantially perpendicular to a plane parallel to the mounting portion.

In one aspect of the invention, the contact mounting portion has two recesses extending transversely toward each other from opposite edges of the planar portion, the recesses having sidewalls adapted to engage edges of a lampholder housing rib, and an inner edge having means for press-fit locking against an inner wall of the rib, so that engagement of the mounting portion with opposed ribs of a lampholder locks the contact in position within the holder. Preferably, the intermediate portion is separated from the mounting portion by a slot extending transversely more than halfway across the width of the mounting portion, the pin-contacting section being connected to the intermediate section by a transitional bend parallel to the longitudinal direction.

Lampholder designs using a pressure contact torque for electrical connection to lead wires advantageously have considerable flexibility in the tongue. According to a second aspect of the invention, the contact is retained by a spacer engaging the rear surface of the mounting portion between the transverse slot and the recesses. The recesses have clearance to the edges of the housing walls and ribs so that the length of the recesses increases the effective spring length.

In still a third aspect of the invention, a unitary lampholder contact includes at least one contact retention finger bent perpendicular to the plane of the contact mounting portion to extend rearwards for engagement by the rear cover. The planar mounting portion aligns the contact to the housing in all coordinates except against relative rearward motion. Similarly to the use of a separate spacer, a contact according to this aspect of the invention requires virtually no insertion force during assembly, and provides reliable retention of the contact when the housing is made of a plastic material that may not hold a pressed contact tightly; but this third aspect of the invention also permits easy handling of the contact by automatic insertion machinery, while saving the cost and handling of a separate spacer.

In a preferred variation of the third aspect of the invention, two contact retention fingers are provided spaced from each other transversely of the longitudinal direction of the contact, the surfaces of the fingers at their side facing the pin-contacting section but against the walls of respective ribs in the lampholder housing, the ribs defining one end of a pocket in which pressure connection tongues of the contact extend. Thus the fingers locate the contact axially so as to absorb the longitudinal force of the connection tongue when a wire has been inserted, and the rearwardly extending fingers provide a fulcrum for the pressure connection tongues. The location of the fingers can be varied to obtain the optimum flexibility of the connection tongues.

Each of the contact embodiments described offers not only the advantage that it has only one major fold line during construction, arranged along an axis which is not critical for bending stress, but also provides the material saving advantage that an electrical connection portion of the contact comprising two pressure connection tongues, the mounting section, and the pin-contacting section prior to bending along the transition all fall within the boundaries of an elongated rectangle, very little of whose metal is wasted, and may be formed by a conventional progressive punching and stamping sequence.

BRIEF DESCRIPTION OF THE DRAWING

In the attached drawing of preferred embodiments of the invention.

DESCRIPTION OF THE PREFERRED EMBODIMENTS

Figure 1:
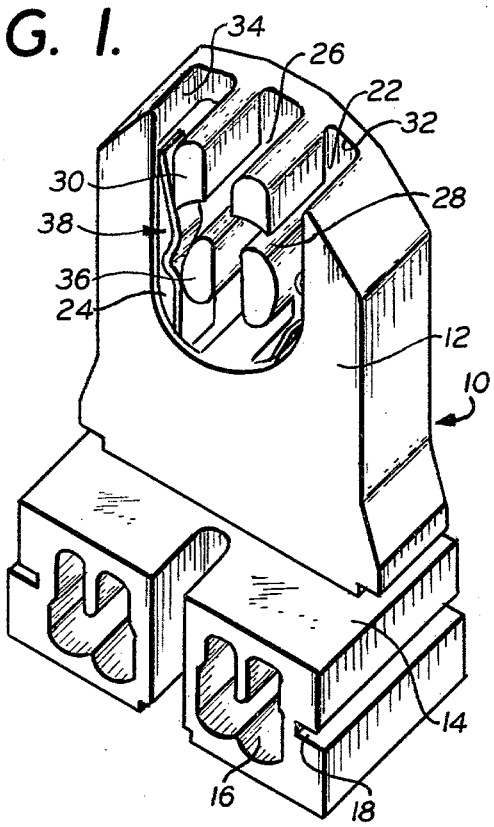
FIG. 1 is a perspective view of a lampholder in accordance with the invention.

FIG. 1 is an overall view of a lampholder having a housing 10 according to the invention, having a vertical front wall 12 rising above a forwardly protruding base 14 of conventional design, the base 14 including connection wire recesses 16 and mounting grooves 18 all formed as part of one synthetic resin molding. The pin slot arrangement is shown very clearly in this view, and consists of a U-shaped slot having two parallel legs 22 connected by a semi-circular bottom portion 24, a center slot 26 extending parallel to the legs 22 downward to and connecting with the bottom portion 24, and two arcuate slot segments 28 between the center slot and the respective legs 22, intersecting the legs 22 where they merge into the bottom portion 24 so as to form a complete circular slot superimposed on the U-shaped slot.

The distal or upper ends of the legs 22 are separated from the center slot 26 by a pair of upper bosses 30 extending forwardly from a rear wall portion 32, the edges 34 of the top wall of the lampholder and corresponding top edges of the bosses 30 being rounded so that lamp pins may be easily guided into either the center slots or the two legs 22. The arcuate slot segments 28 are separated from the center slot 26 and bottom portion 24 by two lower bosses 36 having parallel inner faces facing each other and defining the lower portion of center slot 26, and circular cylindrical outer walls defining the inner surface of the arcuate segments and a portion of the semi-circular bottom slot portion 24. Also visible in FIG. 1, but to be more fully described below, are the pin-contacting sections 38 of the two contact elements in the lampholder.

Figure 2:
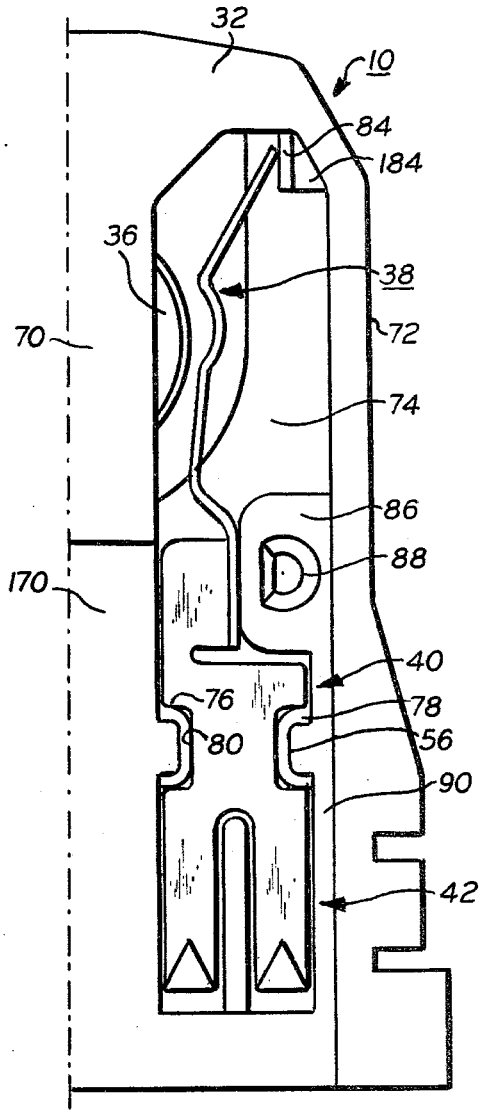
FIG. 2 is a rear view of the lampholder of FIG. 1, with the rear cover removed.
Figure 3:
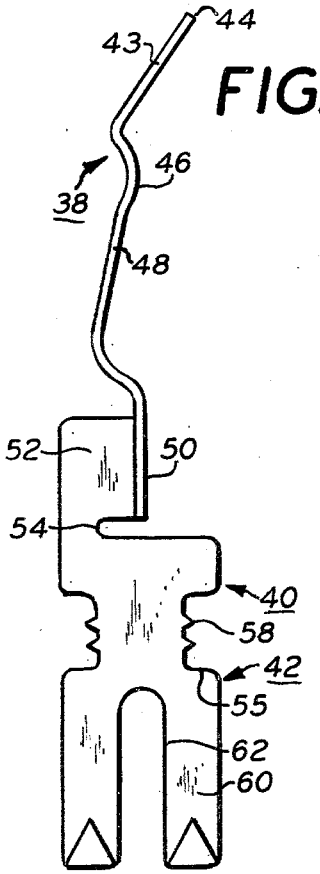
FIG. 3 is an enlarged rear view of a contact element for use in the embodiment of FIG. 1, FIGS. 4*a* and 4*b* are an enlarged view and a cross-sectional view of the pin-gripping portion of a variant of the contact element of FIG. 3.

As seen in FIGS. 2 and 3, a contact element is formed primarily of a pin contacting section 38, a mounting portion 40, and a pressure contact section 42. The pin contacting section is formed as a contoured blade extending generally longitudinally upward and slightly outward, oriented generally perpendicular or edge wise to the front wall 12 so as to be parallel to the axis of a lamp pin which is inserted. The contact section blade has a first portion 43 extending from an upper, distal end 44 downward to a pin-gripping portion 46 which is formed preferably as a cylindrical section having a radius slightly larger than the diameter of a fluorescent lamp pin, the cylinder axis being perpendicular to the lampholder front wall 12. Next below the pin-gripping portion is a second portion 48, also generally planar, and extending generally inward to a point below the location where the contact section crosses below the semi-circular bottom slot portion 24, and then angles outward to a bearing portion 50 lying in a vertical plane.

The pin-contacting section is connected to the mounting portion 40 by a bent transition between the bearing portion 50 and an intermediate portion 52 lying in a plane parallel to the front wall 12, the transition being preferably formed as a cylindrical surface having a radius approximately three times the thickness of the blade stock, with its axis vertical and parallel to the front wall 12. To prevent the forming of the transition bend from deforming the mounting portion 40 at the same time, a slot 54 is provided extending from the outer edge of the contact toward the center line of the lampholder beyond the curved portion of the transition.

Retention of the contact element in the lampholder is performed entirely by the press-fit of the mounting portion 40 within the lampholder housing. To permit reliable retention without the necessity of extremely close tolerances on all parts, the contact element has opposed recesses extending transversely toward each other from the opposite longitudinal edges of the mounting portion, the recesses having a width between recess edges 55 such that those edges provide a slight press-fit against corresponding walls of ribs 56 formed in and extending inward from side walls of the lampholder housing 10 as described below. The bottom of each recess is shaped as a series of small recesses separating sideways extending points 58 for biting into corresponding surfaces of the ribs 56 so as to lock the mounting portion 40, and therefore the entire contact, in place.

The pressure contact section 42 extends downward, preferably as a planar extension of the mounting portion 40, and consists of two tongues 60 separated by a longitudinally extending slot 62, which extends to a location approximately in line with the lower edges 55 of the recesses in the mounting portion, thereby defining a narrowed region at the base of the tongue 60 about which the tongue may deflect resiliently upon insertion of wire as described below. The bottom edge of each tongue preferably is upset to form a "V" depression of the sort well-known in the art for pressure contact engagement of a wire end.

Features relating to the support and retention of the contact in the lampholder housing 10 are seen best in FIG. 2. Extending downward from the upper end of the lampholder housing 10, between the rear wall portions 32, is a central rear wall 70, which defines between it and respective side walls 72 of the housing a pair of symmetrical contact-receiving spaces 74 open to the rear of the housing 10, and closed at the front by the front wall 12 and extending base 14 except for the U-shaped cut-outs forming the U-slot 22, 24 and wire holes (not shown) at the rear of the connection wire recesses 16 and aligned with the "V" depressions 62 of the tongues 60. Extending toward each other respectively from the inner surface of the side wall 72 and the side surfaces of the central wall 70 are the four aforementioned ribs 56 for retention of the contact. The ribs have upper and lower walls 76 at the forward end of the rib adjacent the front wall 12 of the housing 10, spaced apart so as to engage the edges 55 of the contact assembly, while the rear portion of each rib has tapered upper and lower walls 78 to permit easy alignment of the contact mounting portion 40 when inserting it into the respective space 74. Correspondingly, at the forward portion of the recess 74, adjacent front wall 12, the vertical rib walls 80 opposite each other in a recess 74 are spaced apart such a distance that the points 58 of a contact will dig into the walls 80 so as to retain the contact against the forces exerted by inserting wire for pressure contact engagement by the tongues 60. Outwardly tapering vertical walls 82 are provided to the rear of the walls 80 so that a heavy insertion force is required only when the contact has nearly been driven home.

It will be clear that the pin-gripping portion 46 of each contact should be aligned opposite the center of the semi-circular bottom slot portion 24, which is opposite the effective center of the lower bosses 36. In order that there be sufficient retention force to hold a fluorescent tube in place, two opposed contact abutment surfaces 84 are provided on thickened portions at the upper end of the side walls 72, arranged opposite the contact element distal ends 44 to support these ends when the pin-contacting section 38 is displaced outwardly. The lower end of the pin-contacting section is supported against outward displacement by thickened ribs 86 extending outwardly from the front wall 12 alongside the outer walls of the respective bearing portions 50 of the two contacts. In one embodiment the ribs 86 have a sufficient cross-section so that staple holes 88 can be provided for retention of a rear cover, not shown. In an alternative preferred embodiment, staple holes are located in the central rear wall 72, while the rear surface of the ribs 86 may function as a pilot projection (not shown) for aligning a rear cover.

Assembly of the contact into the lampholder housing is extremely easy, it being necessary merely to align the contact generally with the rear opening of the contact receiving space 74, and insert the contact, it being guided into the exact location by the tapered surfaces of the ribs 56, and then finally pressing the mounting portion firmly home against the interior of the front wall 12.

When installing a lamp in the lampholder, it will be clear that when straight-in installation is used, the pins will be guided by the rounded edges 34 into the two legs 22 of the U-slot, will then engage the first portion 43 of the respective contacts and will displace and bend the pin-contacting section 38 between the distal end 44 and the bearing portion 50 as the pin advances downward until it is gripped by the portion 46. Because each pin of the pin-contacting section is supported, the retention force is both closely controlled and repeatable.

If turn-lock installation is used, after the two pins have been passed through the center slot 26 until the lower pin is at the bottom of the slot portion 24, and the upper pin is opposite the arcuate segments 28, upon rotation of the lamp one pin will engage a first portion 43 of the contact to one side of the lampholder, while the other pin engages the second portion 48 of the other contact. As before, upon continued rotation of the tube each of the pin-contacting sections 38 is resiliently bent outward while supported at both ends, until the two pins are locked in the pin-gripping portions 46.

Figure 4A:
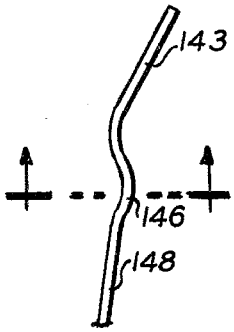
Figure 4B:
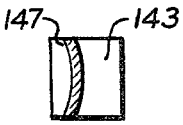

FIGS. 4*a* and 4*b* show an alternative embodiment of a contact providing an edge-contacting feature which has the resilience advantage over known edge-contacting lampholder structures of being basically parallel to the axis of the lampholder pin so that it can be locally displaced more easily. In this contact the first portion 143 and second portion 148 are identical to the corresponding portions 43 and 48 of the contact shown in FIGS. 2 and 3, and the mounting and pressure-contacting portions of the contact would be identical to that previously described. In the pin-gripping portion 146 a compound curvature is formed by upsetting the metal into a two-dimensionally dished configuration rather than a simple cylindrical surface, so that a lampholder pin would make contact along two curved edges 147 rather than along a cylindrical surface. This can provide improved electrical contact where surface oxidation of the contact material or of the pin itself is a special problem.

The lampholder and contact structure described above with respect to FIGS. 1 through 4 is the subject of my application Ser. No. 814,404, of which this application is a continuation in part. It has since been discovered that a greater flexibility in the contact tongues may be desired than is possible when the contact mounting portion is held fast to the front wall of the housing immediately adjacent the root of the pressure contact tongues and that alternatives to the press-fit contact structure are preferred with synthetic resin housing materials such as the urea-formaldehyde molding compounds approved by Underwriters Laboratories and the Canadian Standards Association.

Figure 5:
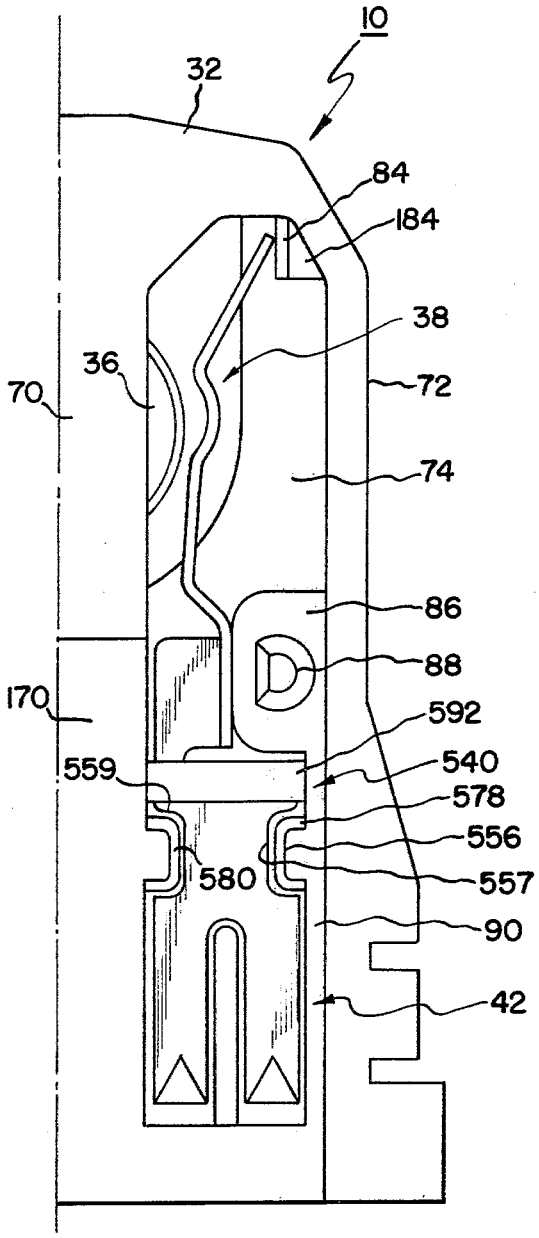
FIG. 5 is a rear view of a lampholder similar to that of FIG. 1, but having a contact retention spacer.

To provide this additional flexibility while assuring reliable contact retention, the embodiment of FIG. 5 utilizes a substantially identical housing and pressure contact, except for a different contact retention structure at the contact mounting portion. There is the further advantage that this variation may be obtained by adding only a single inexpensive element, and making only one small dimensional change either in the contact stamping or in the housing mold.

In the embodiment shown in FIG. 5, the reference numerals and their meanings are identical to FIG. 2 except for those relating to the mounting portion of the contact and the adjoining ribs in the housing.

As shown in FIG. 5, the mounting portion 540 of a non-press-fit contact is held against the inside surface of the front wall 12 of the housing by a spacer 592. The spacer 592 is preferably made of an insulating material, either by punching, shearing or extruding. The spacer 592 may be a press-fit between the adjoining side wall 72 and the lower half 170 of the central rear wall 70. Depending upon preferred shop practices of a particular manufacturer, the spacer can equally well be held in place by cementing between those same walls; or a single spacer assembly can bridge part of the central rear wall and engage both contacts.

The spacer 592 also provides a second function; that is, to form a fulcrum for the pressure contact section 42, spaced as far as possible from the pressure contact ends of the tongues 60. Through the use of the spacer the total lampholder height is still minimized, but the pin-contacting section 38 is isolated fully from the pressure contact section 42 so that insertion and removal of a fluorescent tube does not affect the critical pressure contact with connection wires.

In the embodiment shown in FIG. 5, the ribs 556 are retained, with their tapered walls 578 and 580, but these ribs serve merely as an insertion guide during assembly of the lampholder. Clearance is provided between the recesses 557 and the ribs 556, except that there may be contact between the upper edge 559 of each recess 557 and the corresponding surface on the rib 556.

Figure 6:
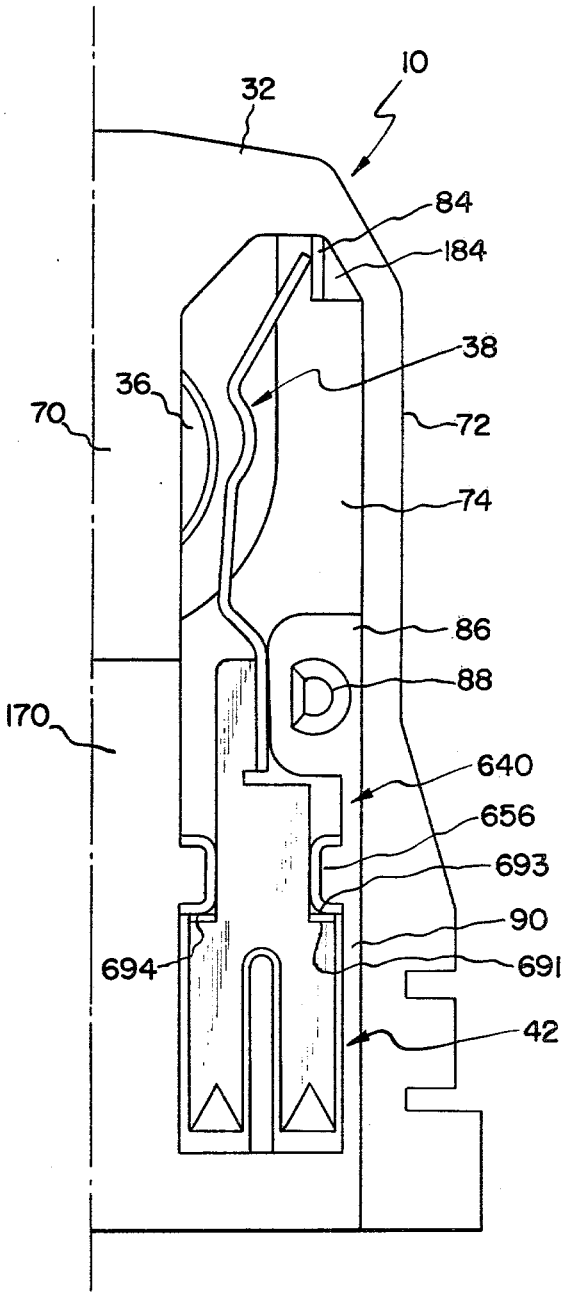
FIG. 6 is a rear view of still another lampholder similar to FIG. 1 but having contact retention fingers extending rearward from the contact mounting portion.

The FIG. 5 embodiment of the invention offers the particular advantage that it can be utilized when only the housing, or only the contact have been modified from the dimensions appropriate to the embodiment of FIG. 2. If, on the other hand, a new contact stamping is to be made, the aspect of the invention represented by the embodiment of FIG. 6 offers additional manufacturing efficiencies. In this embodiment the mounting portion 640 of a non-press-fit contact is held against the inside surface of the front wall 12 of the housing by two contact retention fingers 691 which extend rearwardly from and generally perpendicular to the portion 640 which is planar and have a length which extends just so far to the rear as to butt against the front surface of a rear cover which is installed, for example, by stapling, to the housing as one of the last phases of assembly of the lampholder. The upper surfaces 693 of the retention fingers, which are on the side of the fingers facing the pin contacting section 38 preferably engage the lower surface 694 of ribs 656, which ribs may have the same location and dimensions as the ribs 56 of FIG. 2. These ribs thus define the upper ends of a pocket in which the pressure contact section 42 is located. The location of the lower surface 694 of the ribs and the contact retention fingers 691 may be selected to provide an optimum combination of resilence of the pressure connection tongues and the effective fulcrum location about which the tongues appear to bend so that the end of the tongue which actually presses against a connection wire is not unduly deflected toward the rear cover.

The lampholder and contact embodiments described offer substantial advantage in manufacture, assembly, and performance over prior art lampholders. Not only are there alternative methods for installing and replacing a tube in one and the same lampholder, but the contact described above can equally well be used in housings having a simple, conventional "turn-lock" slot and housings having a simple "straight-in" pair of slots. All of the curved portions or bend lines requiring resilient strength can be aligned with the grain direction of the spring brass stripstock from which such contacts are preferably made. Only one punching and one bending/-stamping operation are required, and the burr direction from stamping can be aligned for advantageous gripping of a connection wire and contact with a lampholder pin. By making the pressure contact tongues and the mounting portion co-planar, manufacturing simplicity is obtained at the same time that front wire insertion is permitted, thus allowing the most compact possible lampholder or fixture design. In the embodiment shown, a U-shaped rear cover is preferably used, the cover rear surface being flush with the rear surface of the side walls 72 and rear wall portion 32; the lower half 170 of the central rear wall 70, the rear surface 184 of the thickened wall portion on which the abutment surface 84 is formed, the rear surface of the thickened rib 86 and a downwardly extending relieved surface 90 are all co-planar so as to provide support for the rear cover, which may be retained by a staple extending cross-wise between the two ribs 86, driven into the staple holes 88, or vertically between two holes (not shown) in the lower central rear wall 170. If the latter alternative is utilized, a part of the rear surface of the ribs 86 may extend rearwardly, flush with the rear surface of the side walls 72, to serve as a locating pilot for a matching notch in the rear cover.

Within the scope of the invention described above and claimed hereinafter, many other alternatives are possible. For example, the entire length or a part of the pressure contact tongues 60 may be angled rearward somewhat, rather than being parallel to the front wall 12, so as to reduce the force necessary to insert connection wires. The various surfaces described as parallel, co-planar or perpendicular may deviate from such relationship by a few degrees without altering the desired functional and structural relationship, although generally at some increase in manufacturing cost. The interference fit by which the FIG. 3 unitary contact element is driven in and held in the housing could be obtained solely along the upper and lower walls of the ribs, or may not use the sharp points described herein so as to dig in and be anchored in the ribs. A contact in accordance with FIG. 6 can be located longitudinally by capturing part 86 and a rib 656, with the retention fingers, or a single retention finger only, extending rearwardly below the rib 656 without touching the rib.

I claim:

1. A contact for a lampholder consisting of a unitary metal element, having a single mounting portion only and means for making electrical connection with the element; a substantially planar section, defining a plane, at least a portion of said planar section being said single mounting portion; and a pin-contacting section extending in a longitudinal direction from said substantially planar section toward and past a pin-contacting region; wherein said longitudinal direction is parallel to said plane defined by the substantially planar section, and said pin-contacting section is perpendicular to said plane.

2. A contact as claimed in claim 1 wherein said mounting portion has two recesses extending transversely toward each other from opposite edges of the planar portion, each of said recesses having side walls adapted for engaging edges of a respective rib in a lampholder housing and an inner edge including means for press-fit locking against an inner wall of the respective rib so that engagement of said mounting portion with ribs of a lampholder locks the contact in position within the holder.

3. A contact as claimed in claim 1 having an intermediate portion coplanar with and separated from said mounting portion by a slot extending transversely more than half-way across the width of said mounting portion, said pin-contacting section being connected to the intermediate section by a bent transition, bent about an axis which is parallel to said longitudinal direction.

4. A contact as claimed in claim 1 comprising a contact retention finger extending rearwardly from said planar mounting portion.

5. A contact as claimed in claim 3 or 4 wherein said contact is a sheet metal stamping having a grain structure oriented in the longitudinal direction, thereby providing maximum strength along the axes of greatest stress.

6. A contact as claimed in claim 1 wherein, at said pin-contacting region said pin-contacting section includes a gripping portion, the gripping portion having an arcuate depression adapted for gripping a circular cylindrical contact pin of a lamp, said arcuate depression additionally being dished along a longitudinally extending axis so as to contact the lamp pin by at least one edge of the dished depression.

7. A contact for a lampholder, having a single mounting portion only; and consisting of a unitary metal element, having a substantially planar section, defining a plane, at least a portion of said planar section being said single mounting portion; a pin-contacting section extending in a generally longitudinal direction from said substantially planar section toward and past a pin-contacting region; and means for making electrical connection with the elements, said means including at least one pressure connection tongue extending longitudinally from and substantially co-planar with said mounting portion, said longitudinal direction being parallel to said plane defined by the substantially planar section, and said pin-contacting section being perpendicular to said plane.

8. A contact as claimed in claim 7 comprising at least one contact retention finger for holding the mounting portion against a front wall of a lampholder, said at least one finger being formed by a portion of the element bent and extending generally perpendicularly from said mounting portion.

9. A contact as claimed in claim 7 or 8 wherein said contact is a sheet metal stamping having a grain structure oriented in the longitudinal direction, thereby providing maximum strength along the axes of greatest stress.

10. A lampholder comprising:

a housing having slot means for accepting lamp pins, including a pair of spaced parallel slots arranged for accepting lamp pins by "straight-in" insertion, and at least one slot intercepting said parallel slot for movement of lamp pins inserted by "turn-lock" insertion; and a pair of electrical contacts for making electrical contact with respective inserted lamp pins of a bi-pin lamp and for retaining said lamp pins, said contacts each having a single pin-gripping portion only for retaining the inserted lamp pins.

11. A lampholder as claimed in claim 10, wherein the housing has a front wall in which said slots are formed, permitting insertion of lamp contact pins along a direction transverse to the axes of the pins, said spaced parallel slots being the legs of a U-shaped slot having a semi-circular bottom portion, the legs of the U-slot being separated by a distance equal to the distance between the contact pins of a lamp; a center slot parallel to the legs of the U-slot extending to the bottom portion; and said at least one slot comprising two arcuate slot segments between the center slot and respective legs arranged so as to form, in conjunction with the semi-circular bottom, a circular slot, and means for mounting said contacts in the housing, each contact including a pin-contacting section having said pin-gripping portion disposed diametrically to a respective side of said circular slot; and said contact means includes means for biasing said pin-gripping portions towards each other so as to protrude into said circular slot in the absence of an inserted lamp pin, each pin-contacting section being so arranged that it can be resiliently moved outward upon insertion of a lamp pin along the leg of the U-slot and upon movement of a lamp pin circumferentially around the circular slot to the pin-gripping portion.

12. A contact as claimed in claim 11 wherein said pin-contacting sections are arranged perpendicular to said front wall and have a distal end and a mounting section; said pin-gripping portion is a portion of said pin-contacting section disposed intermediate the mounting section and the distal end, and formed as an arcuate depression about an axis perpendicular to said front wall, and said housing has opposed contact abutment surfaces perpendicular to said front wall, located between the circular slot and the entrance ends of the U-slot legs, and arranged as recesses of outer walls of respective U-slot legs for engagement by said contact element distal ends, said arcuate gripping depressions being aligned diametrically to opposite sides of the center of the circular slot disposed so as to protrude into said slot in the absence of inserted lamp pins, and arranged to be resiliently moved mutually outwardly upon operative engagement by lamp pins.

13. A lampholder as claimed in claim 11 wherein said housing is a molded synthetic resin body, having a planar front wall having a U-shaped cut-out forming outer edges of said U-slot, side walls extending perpendicular to said front wall, a transverse upper rear wall portion extending between said side walls adjacent distal ends of said U-slot legs, and a central rear wall portion extending downward parallel to said front wall, said slot interior edges being formed by four contoured bosses extending forwardly from at least one of said rear wall portions.

14. A lampholder as claimed in claim 13 wherein each contact element includes a planar mounting portion arranged parallel to said front wall; and said housing has a bottom wall and a connection-wire receiving portion between said bottom wall and said front wall, said central rear wall extends downward to said bottom wall and defines a contact-receiving space to each side of the central wall; two contact mounting ribs protruding into each contact receiving space for engagement by respective planar mounting portions, a first rib extending rearwardly from said front wall along an inside surface of a side wall, and a second rib extending rearwardly from said front wall to said central rear wall, respective planar mounting portions being retained by a press-fit engagement with respective first and second ribs.

15. A lampholder as claimed in claim 13 wherein each contact element includes a planar mounting portion arranged parallel to said front wall, and at least one pressure connection tongue for making electrical connection with the contact element, said pressure connection tongue extending longitudinally and substantially co-planar with said mounting portion;

said housing has a bottom wall and a connection-wire receiving portion between said bottom wall and said front wall, said central rear wall extends downward to said bottom wall and defines a contact-receiving space to each side of the central wall; and the lampholder includes a contact retention element extending rearwardly from the planar mounting portion in said contact receiving space, and pressing said planar mounting portion against the front wall of the lampholder so as to retain the contact in position.

16. A lampholder as claimed in claim 14 or 15 wherein each contact element has a pin-contacting section arranged perpendicular to said front wall and having a distal end and bearing portion, said pin-gripping portion being intermediate said distal end and bearing portion;

said housing has opposed contact abutment surfaces perpendicular to said front wall, located between the circular slot and the distal ends of the U-slot legs, and arranged as recesses of outer walls of the respective legs, for engagement by said contact element distal ends; and a third rib extending rearwardly from said front wall along each side wall, protruding into the respective contact-receiving space below the U-shaped cut-out and above the first rib, said bearing portion being arranged adjacent an inner surface of said third rib, such that upon outward displacement of said pin-gripping portion due to operative engagement by an inserted lamp pin, said contact section is supported by said distal end and said bearing portion.

17. A lampholder as claimed in claim 16 wherein said third ribs each has a forwardly extending staple hole, whereby a horizontally disposed staple can be applied to the lampholder housing for attaching a rear cover.

18. A lampholder as claimed in claim 15 wherein said housing includes a respective contact mounting rib protruding into each contact receiving space for engagement by a respective planar mounting portion of a contact to align the contact longitudinally.

19. A lampholder as claimed in claim 18 wherein said contact retention element is a contact retention finger bent and extending perpendicuarly to the rear from the contact mounting portion, said retention finger having an upper surface facing the pin contacting section, which upper surface engages a lower surface of the respective rib.

* * * * *